US008134549B2

(12) United States Patent
Han et al.

(10) Patent No.: US 8,134,549 B2
(45) Date of Patent: Mar. 13, 2012

(54) IMAGE PROCESSING APPARATUS AND METHOD OF REDUCING POWER CONSUMPTION OF SELF-LUMINOUS DISPLAY

(75) Inventors: Young-ran Han, Suwon-si (KR); Ho-young Lee, Suwon-si (KR); Du-sik Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 896 days.

(21) Appl. No.: 11/761,875

(22) Filed: Jun. 12, 2007

(65) Prior Publication Data

US 2008/0252628 A1 Oct. 16, 2008

(30) Foreign Application Priority Data

Jun. 19, 2006 (KR) ..... 10-2006-0055033

(51) Int. Cl.
*G09G 5/00* (2006.01)

(52) U.S. Cl. ..... 345/211; 345/41; 345/60; 382/181

(58) Field of Classification Search ..... 345/211, 345/37, 41, 60, 204; 382/181, 274, 254, 382/168

See application file for complete search history.

(56) References Cited

U.S. PATENT DOCUMENTS 6,445,833 B1 * 9/2002 Murata et al. ..... 382/285
6,980,180 B2 12/2005 Hasagawa
7,139,036 B2 * 11/2006 Wang et al. ..... 348/625
2003/0210256 A1 11/2003 Mori et al.
2004/0190789 A1 * 9/2004 Liu et al. ..... 382/274
2004/0201582 A1 * 10/2004 Mizukoshi et al. ..... 345/211
2004/0263495 A1 * 12/2004 Sugino et al. ..... 345/204
2005/0056841 A1 * 3/2005 Yamazaki et al. ..... 257/59
2005/0057448 A1 3/2005 Jeong
2005/0140640 A1 6/2005 Oh et al.
2006/0012547 A1 1/2006 Chang
2006/0044227 A1 3/2006 Hadcock
2006/0119612 A1 * 6/2006 Kerofsky et al. ..... 345/590
2006/0202036 A1 * 9/2006 Wang et al. ..... 235/462.07
2006/0268180 A1 * 11/2006 Chou ..... 348/673

(Continued)

FOREIGN PATENT DOCUMENTS

JP 10-039832 2/1998

(Continued)

OTHER PUBLICATIONS

Partial European Search Report dated Feb. 8, 2010 and issued in corresponding European Patent Application 07110295.8.

(Continued)

*Primary Examiner* — Amare Mengistu
*Assistant Examiner* — Premal Patel
(74) *Attorney, Agent, or Firm* — Staas & Halsey LLP

(57) ABSTRACT

An image processing apparatus and a method to reduce power consumption of a self-luminous display. The image processing apparatus includes a parameter selection unit to select a parameter to adjust a degree to which power consumption is reduced; a scale factor setting unit to extract a high-frequency component of a current pixel in an input image and to set a scale factor according to the selected parameter and a size of the extracted high-frequency component; and a multiplier to multiply the current pixel by the set scale factor and to output a result of the multiplication.

39 Claims, 16 Drawing Sheets

U.S. PATENT DOCUMENTS

| | | | | |
|---|---|---|---|---|
| 2006/0274026 | A1* | 12/2006 | Kerofsky | 345/102 |
| 2007/0009167 | A1* | 1/2007 | Dance et al. | 382/254 |

FOREIGN PATENT DOCUMENTS

| | | |
|---|---|---|
| JP | 2001-022318 | 1/2001 |
| JP | 2004-246099 | 9/2004 |
| JP | 2005-315956 | 11/2005 |
| JP | 2006-030289 | 2/2006 |
| JP | 2006-091850 | 4/2006 |
| KR | 2003-42499 | 6/2003 |
| KR | 2004-69583 | 8/2004 |
| KR | 2004-70948 | 8/2004 |
| KR | 2005-23773 | 3/2005 |
| KR | 2005-33085 | 4/2005 |
| KR | 2005-61797 | 6/2005 |
| KR | 2005-119559 | 12/2005 |
| KR | 2005-121923 | 12/2005 |
| KR | 2005-122026 | 12/2005 |
| KR | 2006-14213 | 2/2006 |
| KR | 10-700405 | 3/2007 |
| WO | WO 2004/097777 | 11/2004 |

OTHER PUBLICATIONS

English Abstract for Korean Patent Application No. 10-700405.
Notice of Allowance issued on Jun. 29, 2007 in the Korean Intellectual Property Office for Korean Patent Application No. 2005-55033.

* cited by examiner

IMAGE PROCESSING APPARATUS AND METHOD OF REDUCING POWER CONSUMPTION OF SELF-LUMINOUS DISPLAY

CROSS-REFERENCE TO RELATED APPLICATION

This application claims priority from Korean Patent Application No. 2006-55033 filed on Jun. 19, 2006 in the Korean Intellectual Property Office, the disclosure of which is incorporated herein by reference in its entirety.

BACKGROUND OF THE INVENTION

1. Field of the Invention

An aspect of the present invention relates to an image display apparatus, and, more particularly, to an image processing apparatus and a method of reducing power consumption of a self-luminous display.

2. Description of the Related Art

Recently, display apparatuses have been introduced in response to the development of computers and the spread of the Internet. These display apparatuses are embedded in a wide variety of devices ranging from devices that require relatively large displays (such as digital televisions (TVs) and monitors), and to portable devices that require small and convenient displays (such as cellular phones and personal data assistants (PDAs)). Unlike the large devices, portable devices are powered by charging type batteries. Therefore, reducing power consumption of the portable devices to increase the time during which the portable devices can be used is important.

Display apparatuses are largely classified into transmissive display apparatuses (such as liquid crystal displays (LCDs)), and self-luminous display apparatuses (such as plasma display panels (PDPs), and organic light emitting diodes (OLEDs)).

FIG. 1 illustrates the light-emitting principle of a conventional LCD 10. The LCD 10 receives a white backlight 11 from a backlight unit and either passes the white backlight 11 through a liquid crystal layer 12 or blocks the white backlight 11. The transmittance of the backlight 11 is controlled by varying the arrangement of electrodes 13 formed on both surfaces of the liquid crystal layer 12 according to a voltage applied to the electrodes 13. Here, the transmitted light is converted by a color filter 14 into a color 15 and then output to the exterior of the LCD 10. To reduce power consumption, transmissive display apparatuses, such as the LCD 10, use a method of uniformly adjusting the brightness of a backlight source regardless of image information because the power consumed by the backlight source remains unchanged regardless of whether the image information indicates black or white regions.

A conventional technology for reducing the power consumption of a transmissive display apparatus has been disclosed by Samsung Electronics Co., Ltd. in Korean Patent Publication No. 2005-0061797. Here, a driving voltage level is controlled using an average luminance value received. Hence, when the average luminance value is greater than a predetermined value, the amount of light is reduced, and when the average luminance value is less than the predetermined value, the amount of light is increased. In so doing, power consumption of the transmissive display apparatus may be reduced while the deterioration of the overall luminance of the transmissive display apparatus may be prevented. In addition, Toshiba Corporation discloses, in Japanese Patent Publication No. 2004-246099, another conventional technology for extracting a luminance signal component of an input signal, highlighting the extracted luminance signal component, and then reducing the amount of light of a backlight.

FIG. 2 illustrates the light-emitting principle of a conventional OLED 20. As shown in FIG. 2, electrodes 22 and 24 are formed on both surfaces of an organic thin film 23 of the OLED 20. Electrons are injected through these electrodes 22 and 24, and excitation of holes is formed. Light 26, having a particular wavelength, is generated by energy from the formed excitation. The conventional OLED 20 emits red, green and blue (RGB) colors according to the type of organic matter contained in the organic thin film 23, thereby representing a full color band. The intensity of the generated light 26 is determined by the intensity of current supplied from a power source 21.

A conventional technology to reduce power consumption of a self-luminous display apparatus has been disclosed by Samsung SDI Co., Ltd. in Korean Patent Publication No. 2004-0069583. Specifically, this conventional technology relates to a plasma display calculating an average luminance level of an input image, and, if the average luminance level is less than a predetermined level, calculating the difference between average luminance levels of frames and then reducing the power consumption of a current frame. In addition, Korean Patent Publication No. 2004-0070948 assigned to Samsung Electronics Co., Ltd. discloses a technology to calculate an average luminance level of an input image, to set a power consumption level, and to display the input image on a PDP according to the set power consumption level. Also, U.S. Patent Publication No. 2006-0044227 assigned to Kodak discloses a technology for generating a calibration curve indicating the relationship between a driving voltage and current (luminance) in an OLED and controlling the driving voltage based on the calibration curve.

Low-power technology can be used to reduce the power consumption of transmissive display apparatuses. However, since self-luminous display apparatuses inherently do not have backlights, the efficiency of power consumption of the self-luminous display apparatuses can be enhanced only by reducing the size of an input signal. In other words, while transmissive display apparatuses consume a constant level of power regardless of luminance, the luminance of self-luminous display apparatuses is proportional to an amount of flowing current (power consumption).

FIG. 3 illustrates power consumed by a self-luminous display apparatus according to characteristics of an image displayed thereon. Theoretically, when a black image is displayed on the self-luminous display apparatus, the power consumption of the self-luminous display apparatus is nearly 0%. When a white image is displayed, the power consumption of the self-luminous display apparatus is nearly 100%. In the case of a general image, the power consumption is somewhere between 0 and 100%.

A still image consumes 50-60% of total power, whereas a moving image consumes relatively less power, i.e., 20-30% of the total power. In addition, a black character in a white background consumes more power (70-80% of the total power) than a white character in a black background (20-30% of the total power).

As is described above, since self-luminous display apparatuses control brightness using the amount of current, they consume a lot of power when emitting bright light. Therefore, a reduction in power consumption is essential for the self-luminous display apparatuses to be used for mobile devices to which it is difficult to supply power in a stable manner.

Most conventional technologies to drive LCDs and PDPs use a method of lowering backlight to a constant level by reducing voltage or displaying an input image at a power level set by flowing current according to a predetermined power consumption level. The above discussed OLED low-power technology disclosed by Kodak is also a voltage control method according to a predetermined power level.

However, if driving voltages for all signals of an image are uniformly lowered, the brightness of undesired portions of the image by a user is also lowered, thereby deteriorating image quality. Therefore, a technology to reduce power consumption by analyzing characteristics of an input image based on a human visual system and dynamically controlling a level of a signal (pixel value) based on the analyzed characteristics of the input image is required.

SUMMARY OF THE INVENTION

Aspects of the present invention provide a method of dynamically controlling power consumption of a self-luminous display apparatus according to characteristics of an input image.

According to an aspect of the present invention, there is provided a parameter selection unit to select a parameter to adjust a degree to which power consumption is reduced; a scale factor setting unit to extract a high-frequency component of a current pixel in an input image and to set a scale factor according to the selected parameter and a size of the extracted high-frequency component; and a multiplier to multiply the current pixel by the set scale factor and to output a result of the multiplication.

According to another aspect of the present invention, there is provided an image processing apparatus to reduce power consumption of a self-luminous display. The apparatus includes a parameter selection unit to select a parameter to adjust a degree to which power consumption is reduced, a scale factor setting unit to calculate a distance between a current pixel in an input image and a center of the input image and to set a scale factor according to the selected parameter and the calculated distance; and a multiplier to multiply the current pixel by the set scale factor and to output a result of the multiplication.

According to another aspect of the present invention, there is provided an image processing apparatus to reduce power consumption of a self-luminous display. The image processing apparatus includes a parameter selection unit to select a parameter to adjust a degree to which power consumption is reduced; a scale factor setting unit to calculate a temporal gradient of the luminance of a current pixel in an input image and to set a scale factor according to the selected parameter and the calculated temporal gradient; and a multiplier to multiply the current pixel by the set scale factor and to output a result of the multiplication.

According to another aspect of the present invention, there is provided an image processing apparatus to reduce power consumption of a self-luminous display. The image processing apparatus includes a parameter selection unit to select a parameter to adjust a degree to which power consumption is reduced; a scale factor setting unit to extract a luminance component of a current pixel in an input image and to set a scale factor according to the selected parameter and a size of the extracted luminance component; and a multiplier to multiply the current pixel by the set scale factor and to output a result of the multiplication.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
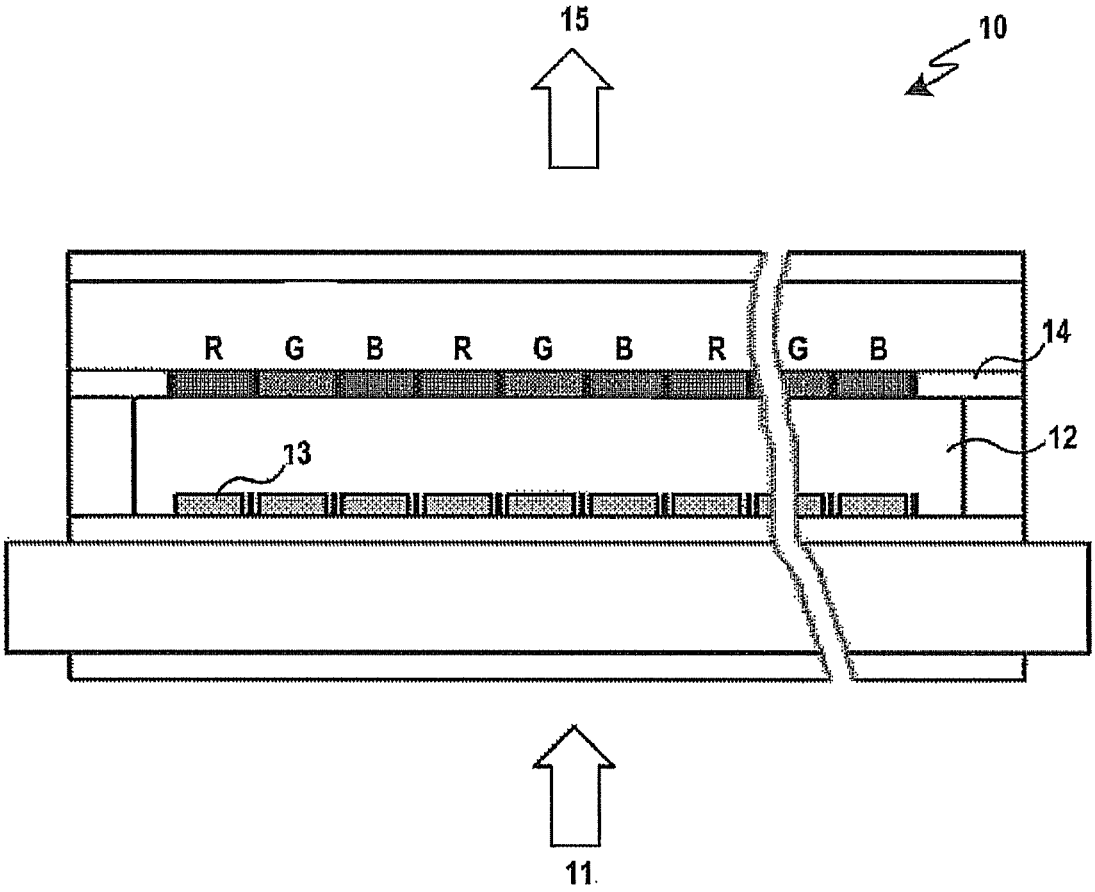
FIG. 1 (PRIOR ART)
FIG. 1 illustrates the light-emitting principle of a conventional liquid crystal display (LCD)
Figure 2:
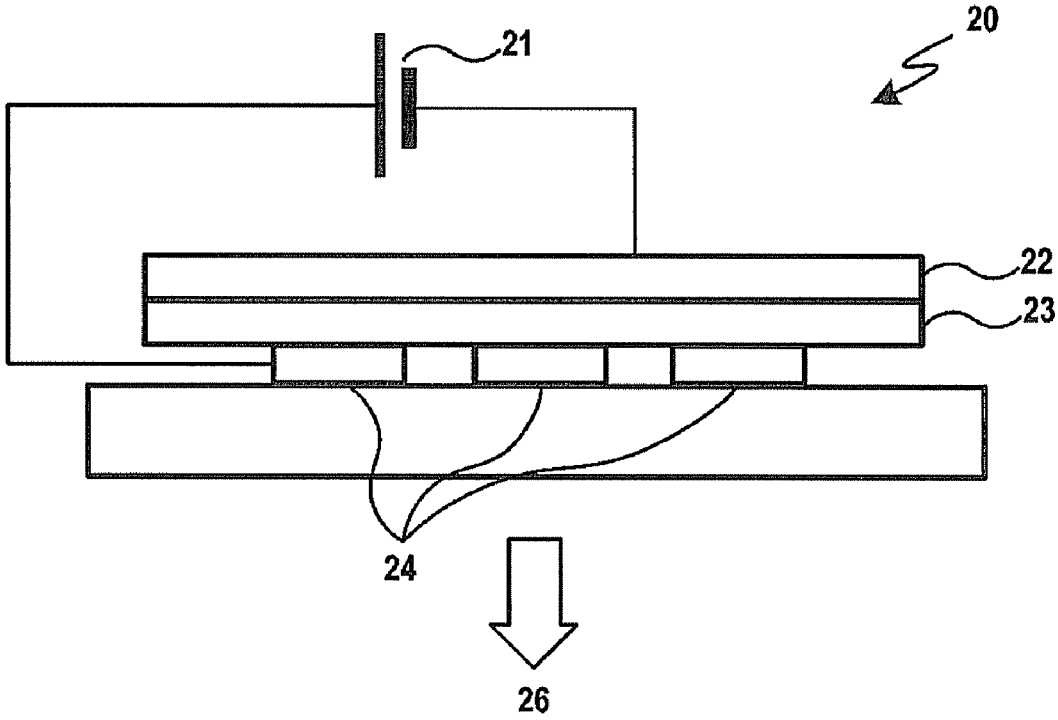
FIG. 2 (PRIOR ART)
FIG. 2 illustrates the light-emitting principle of a conventional organic light emitting diode (OLED)
Figure 3:
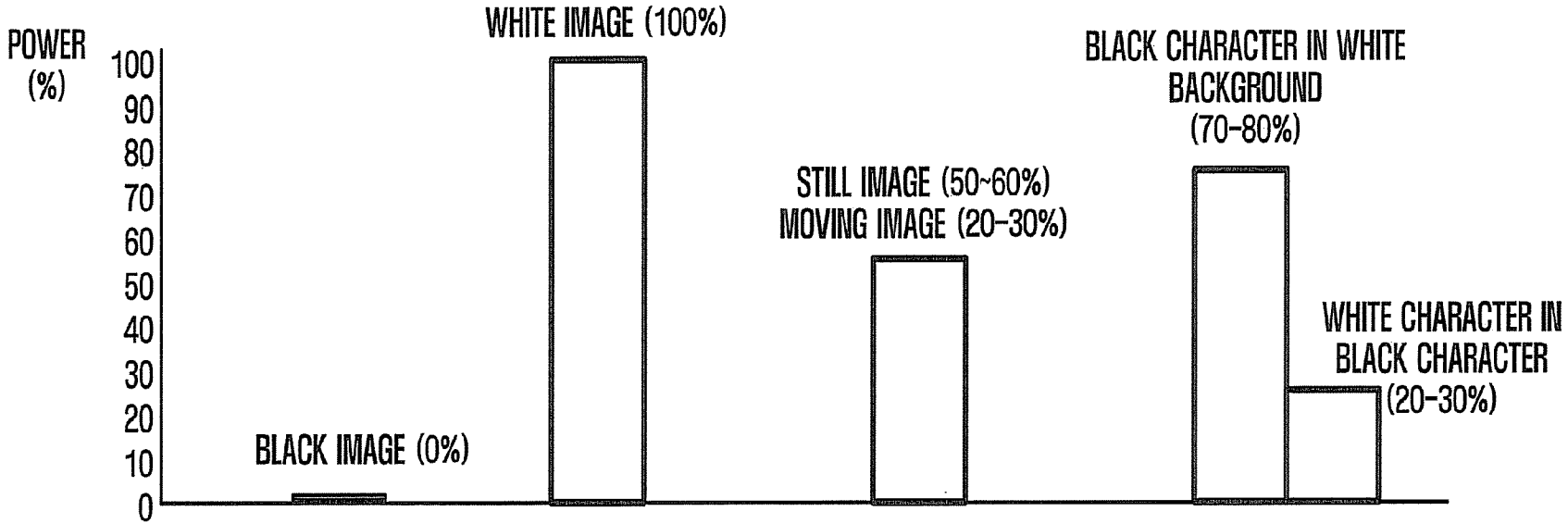
FIG. 3 (PRIOR ART)
FIG. 3 illustrates power consumed by a self-luminous display apparatus according to characteristics of an image displayed thereon.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 4A:
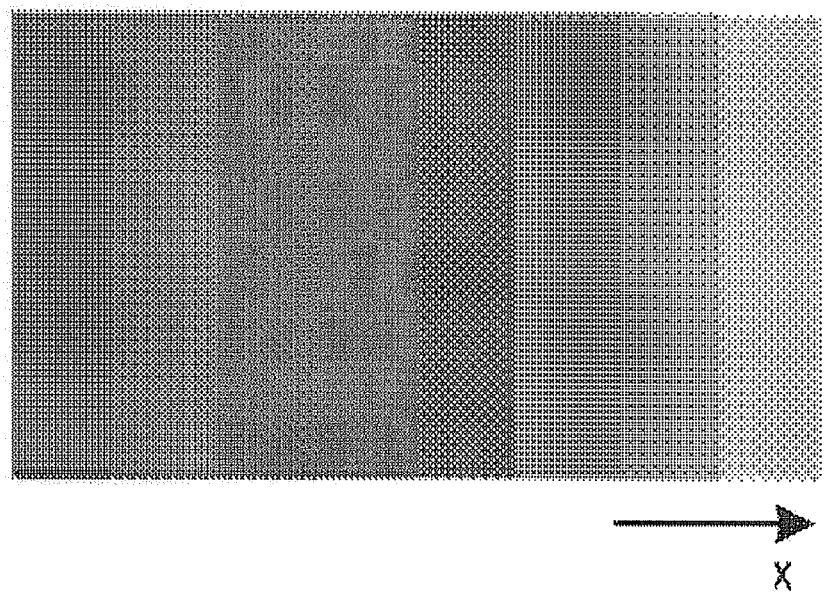
FIG. 4A illustrates an image whose luminance increases at regular intervals.
Figure 4B:
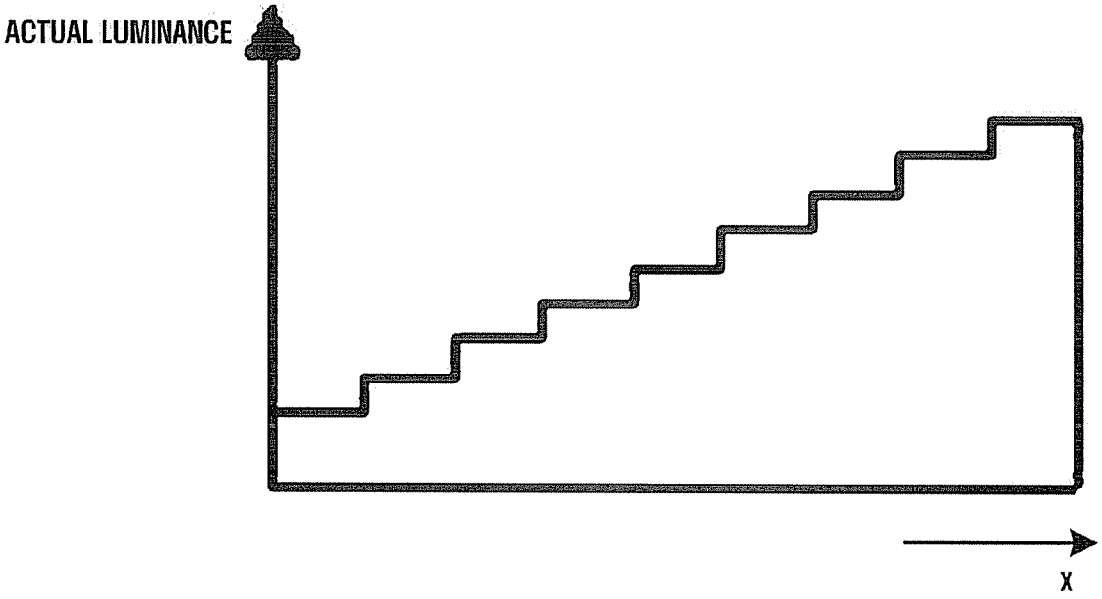
FIG. 4B is a graph illustrating the actual luminance of the image of FIG. 4A.

A human visual system will be described with reference to FIGS. 4A through 6. FIGS. 4A and 4B illustrate a Mach band effect. The Mach bend effect refers to an effect in which the human visual system accentuates boundary areas of an image when brightness rapidly changes.

Figure 4C:
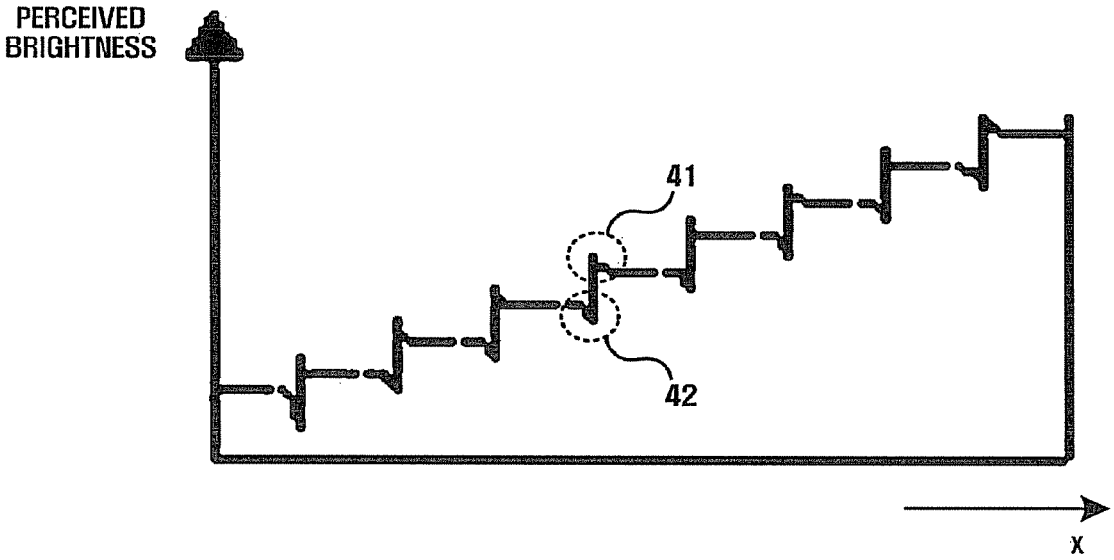
FIG. 4C is a graph illustrating the image of FIG. 4A perceived by a human visual system.

If an image is composed of a bar whose luminance increases at regular intervals along an x-axis as illustrated in FIG. 4A, the actual luminance of the image produces a stepped graph as illustrated in FIG. 4B. However, the brightness of the image illustrated in FIG. 4A is perceived by the human visual system as being somewhat distorted as illustrated in FIG. 4C. In other words, the human visual system perceives a dark portion 42 in a boundary area of the bar as being darker and a bright portion 41 as being brighter. The boundary area is a high-frequency area from the perspective of frequency. Even if the luminance (signal level) of the boundary area is somewhat reduced, the human visual system is not greatly affected.

Figure 5:
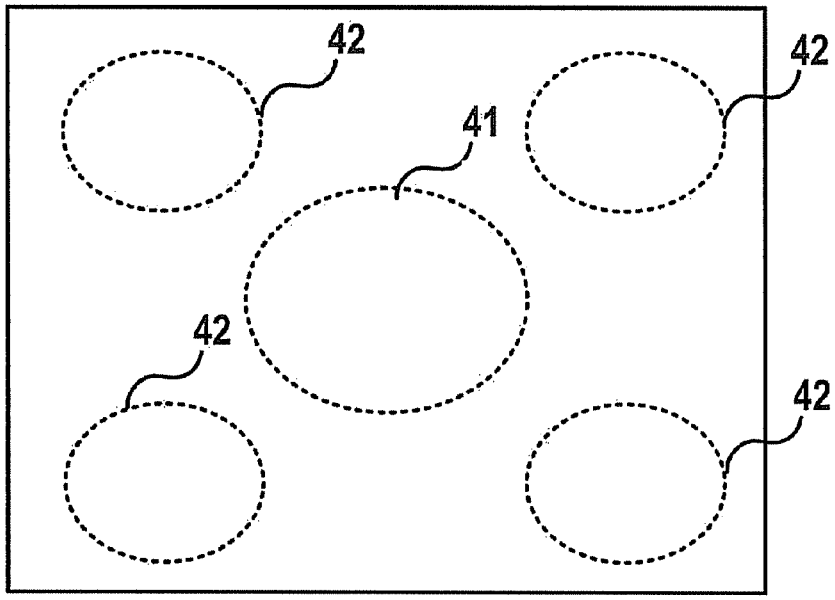
FIG. 5 is a diagram illustrating a different sensitivity of the human visual system to a location in an image.

FIG. 5 is a diagram illustrating a different sensitivity of the human psychological visual system to a location in an image. Since the human visual system takes a great interest in a center area 41 of the image, it becomes less sensitive to a change from the center area 41 toward outer areas 42 of the image. Therefore, even if the signal level of the outer areas 42 of the image is somewhat reduced, subjective image quality is not greatly affected.

Figure 6:
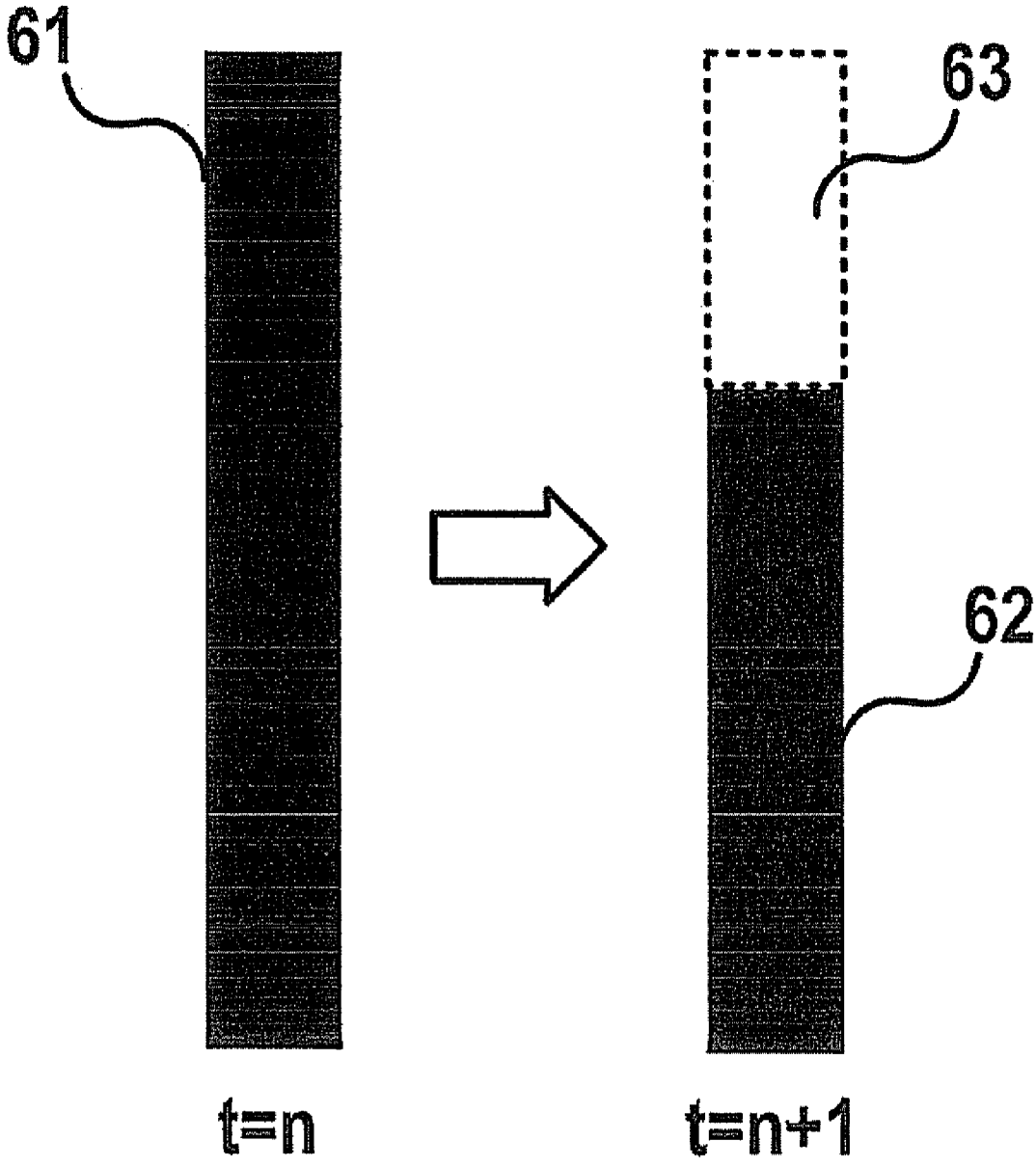
FIG. 6 is a diagram illustrating characteristics of human perception of rapidly changing images in a moving image.

FIG. 6 is a diagram illustrating characteristics of human perception of rapidly changing images in a moving image. If an image 61 at a time (t=n) becomes an image 62 that is moved downward at a next time (t=n+1), the human visual system perceives an area 63 that is changed after the movement of the image 61 as a mixed signal during the two times. For example, if the image 61 is black and the background is white, the area 63 is perceived by the human visual system as grey (i.e., a mixture of black and white). Therefore, even if the signal level of an area or pixel having a large movement is somewhat reduced, such a reduction may not be clearly perceived by the human visual system.

Figure 7:
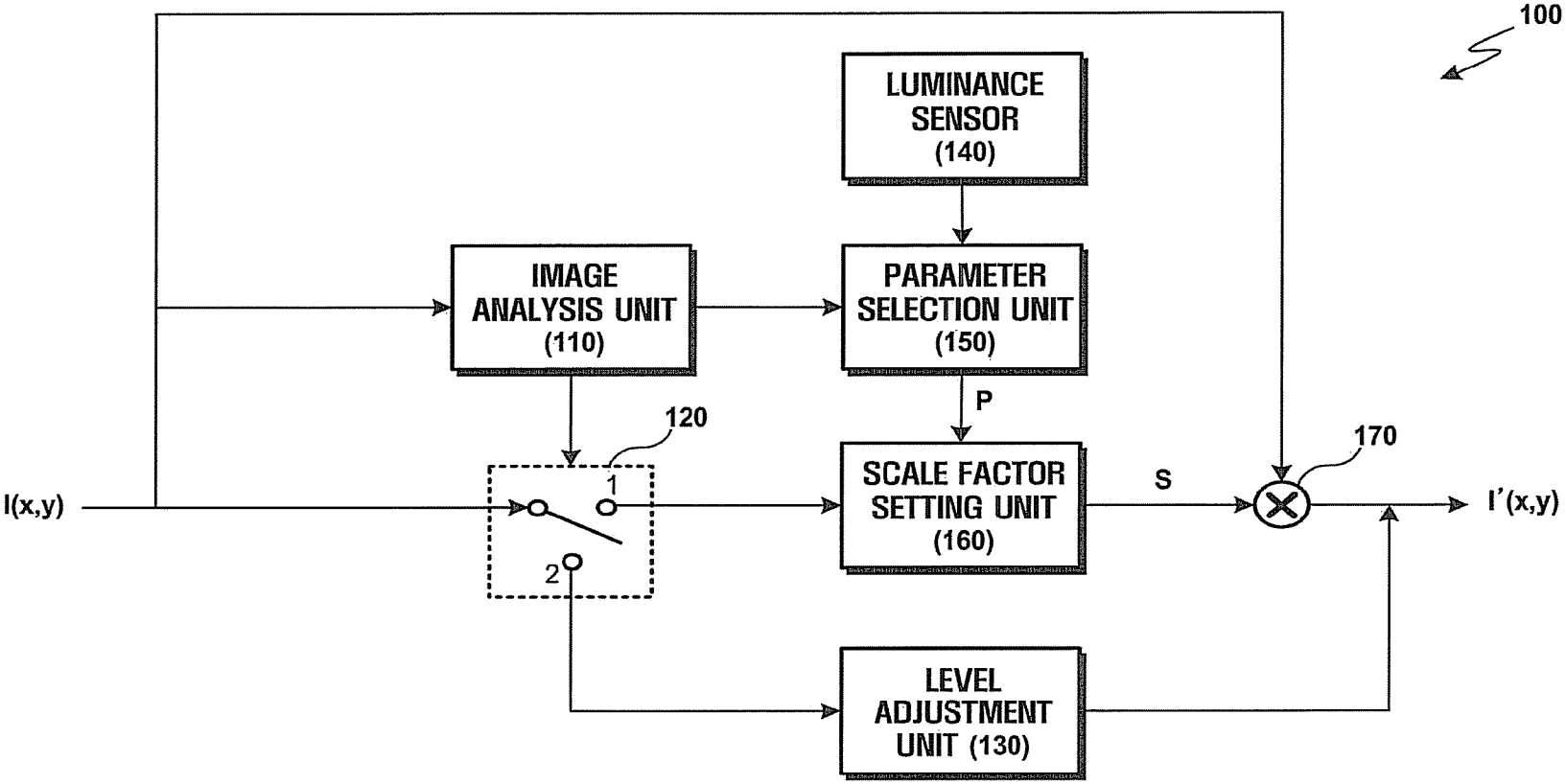
FIG. 7 is a block diagram of an image processing apparatus according to an embodiment of the present invention.

FIG. 7 is a block diagram of an image processing apparatus 100 according to an embodiment of the present invention. As shown in FIG. 7, the image processing apparatus 100 includes an image analysis unit 110, a switch 120, a level adjustment unit 130, a luminance sensor 140, a scale factor setting unit 160, and a first multiplier 170. The image processing apparatus 100 of FIG. 7 is an embodiment of the present invention, and the above components of the image processing apparatus 100 may be selectively included or excluded as needed. While not required in all aspects, the image processing apparatus 100 can be incorporated in a display, such as a self-luminous display, a plasma display panel (PDP), or an organic light emitting diodes (OLEDs). Moreover, it is understood that the display can be non-portable, or portable as in the case of a mobile TV, portable computers, telephone, and mobile players.

Figure 8A:
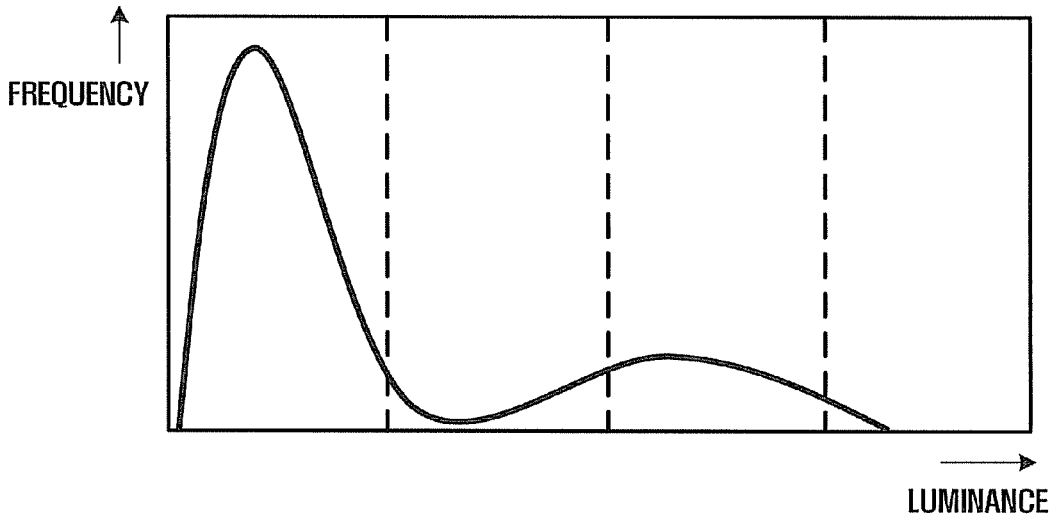
FIG. 8A illustrates an example of a histogram of a dark image.
Figure 8B:
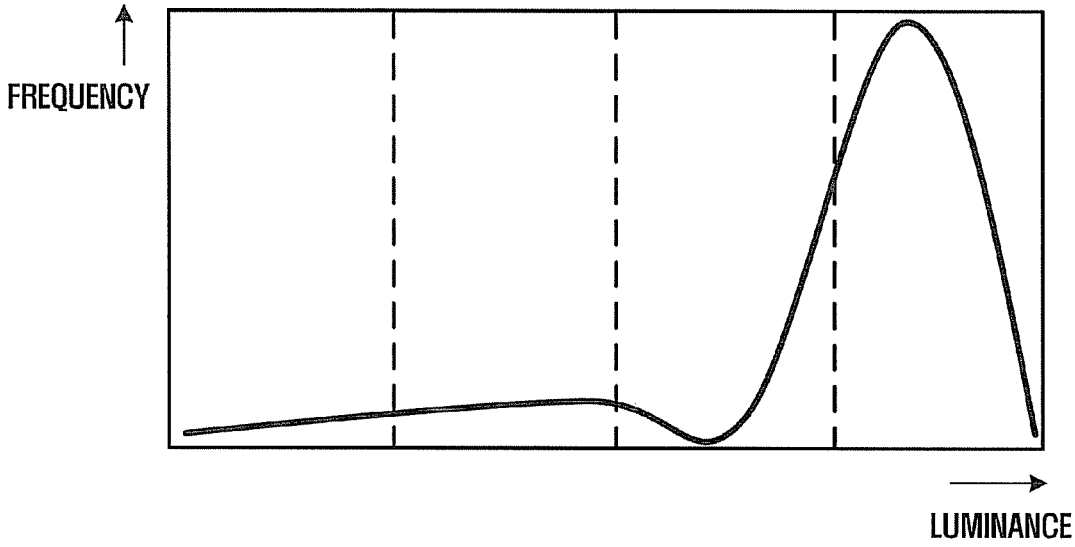
FIG. 8B illustrates an example of a histogram of a bright image.
Figure 8C:
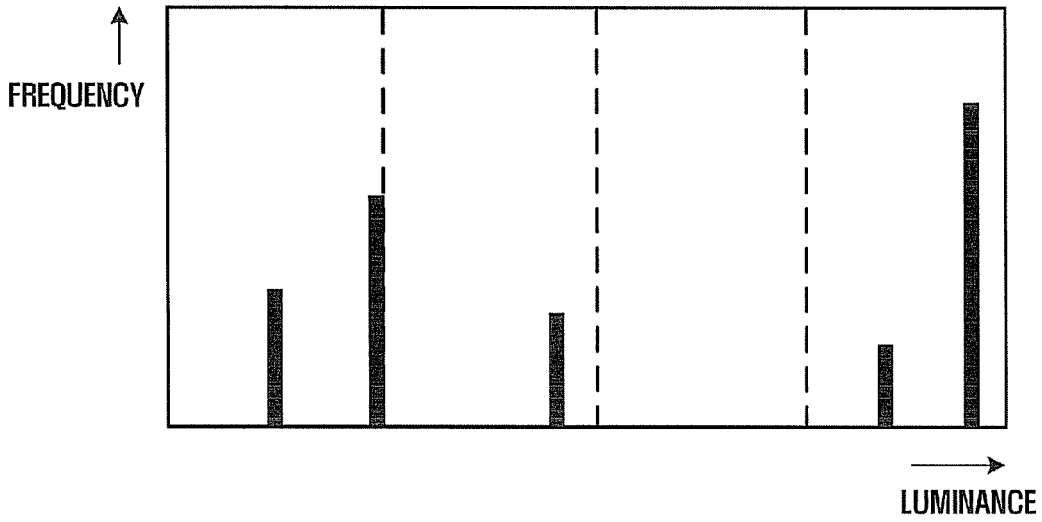
FIG. 8C illustrates an example of a histogram of a graphic image.

First, the image analysis unit 110 generates a histogram by extracting a luminance component $I_{(x, y)}$ of an input image, analyzes the distribution of the generated histogram, and classifies the input image based on the analysis result. FIGS. 8A through 8C are histograms illustrating types of images classified by the image analysis unit 110. The image analysis unit 110 may classify input images into, for example, four types of images. The first type of images are dark images as illustrated in FIG. 8A, the second type of images are bright images as illustrated in FIG. 8B, and the third type of images are graphic images as illustrated in FIG. 8C. All images that do not belong to one of the three types are classified as general images. While not required in all aspects, it is understood that additional types of images can be formed.

An example of a quantitative standard for making this classification will now be described. In the histogram of FIG. 8A, the entire luminance range (e.g., 0-255 in the case of an 8-bit image) is divided into four luminance ranges. When a sum of the frequency, with which the luminance level of an image belongs to a lowest luminance range, exceeds a predetermined threshold value (e.g., 50%), the image may be classified as a dark image. Similarly, in the histogram of FIG. 8B, the entire luminance range is divided into four ranges. When a sum of the frequency, with which the luminance level of an image belongs to a highest luminance range, exceeds a predetermined threshold value, the image may be classified as a bright image.

An image may be classified as a graphic image as illustrated in FIG. 8C based on whether the number of luminance levels having zero frequency, that is, the number of Zero Bins, exceeds a predetermined threshold value. Since a graphic image includes a plurality of images of a single color, an image adjustment method different from the image adjustment method used for other images is required. All images that do not belong to the above types of images may be classified as general images.

The switch 120 switches the luminance component $I_{(x, y)}$ of the input image to the scale factor setting unit 160 or the level adjustment unit 130 based on the type of the input image classified by the image analysis unit 110. Specifically, whether to switch the luminance component $I_{(x, y)}$ of the input image to the scale factor setting unit 160 or the level adjustment unit 130 is determined based on whether the input image is a graphic image. When the input image is a graphic image, it may not be advantageous to use an image adjustment method according to the present invention. Therefore, a conventional level adjustment method is used. Conversely, when the input image is not a graphic image, a scale adjustment method suggested in an embodiment of the present invention is used.

Figure 9:
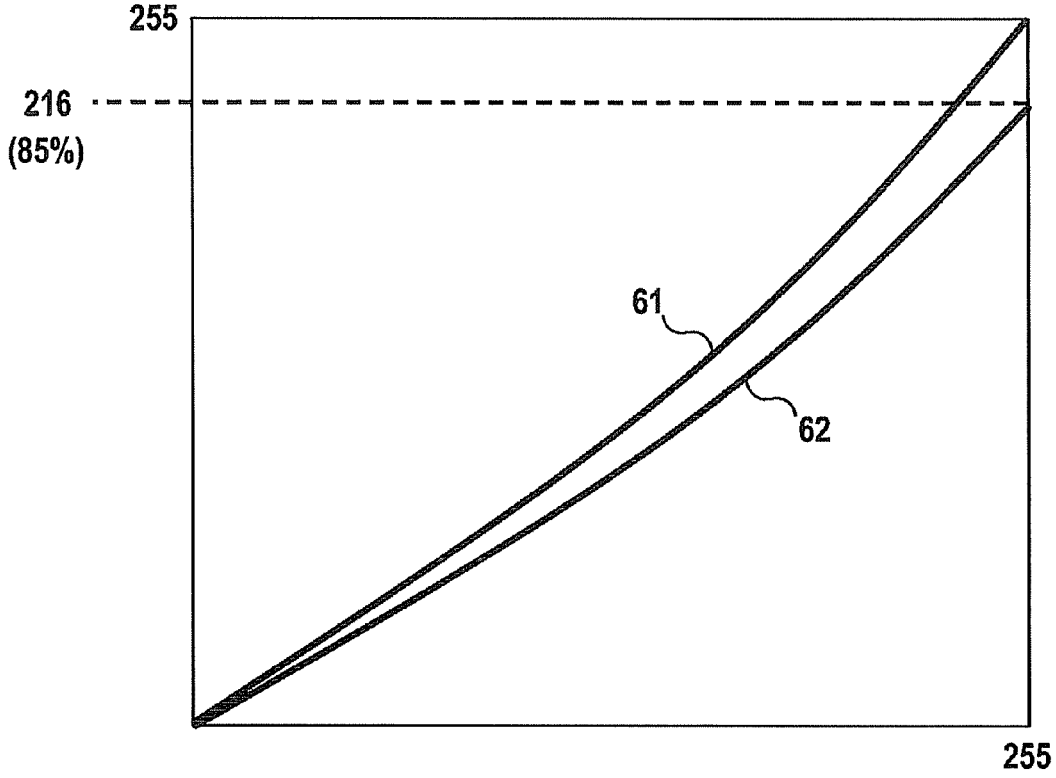
FIG. 9 is a graph illustrating a level adjustment method used by a level adjustment unit included in the image processing apparatus of FIG. 7.

The level adjustment unit 130 uniformly scales down the level of the input image or the luminance component $I_{(x, y)}$ of the input image FIG. 9 is a graph illustrating an example of a level adjustment method used by the level adjustment unit 130. As shown in FIG. 9, a gamma curve 61 of an input image is uniformly scaled down by a level adjustment rate (e.g., 0.85). After the gamma curve 61 is downscaled by the level adjustment rate for all luminance levels of the input image, a gamma curve 62 is obtained. The level adjustment rate may be determined by a user or may be based on a default value.

When the image analysis unit 110 determines that the input image is not a graphic image, a parameter selection unit 150 selects a parameter P that is appropriate for the input image and provides the selected parameter P to the scale factor setting unit 160. The shown example of the present invention suggests four types of image adjustment parameters: a frequency parameter Frequency_Para, a spatial parameter Spatial_Para, a temporal parameter Temporal_Para, and a luminance parameter Luminance_Para. These parameters may be used by the scale factor setting unit 160 to calculate a scale factor. The higher the parameter value, the greater the image adjustment, that is, the greater the reduction in power consumption. However, additional or fewer parameters may be used on other aspects of the invention.

The values of the parameters may be experientially determined. Table 1 shows exemplary values of the parameters according to the classification of input images.

TABLE 1

| Parameter | General Image | Dark Image | Bright Image |
|---|---|---|---|
| Frequency_Para | 1.3 | 1.3 | 1.3 |
| Spatial_Para | 0.6 | 0.4 | 0.6 |
| Temporal_Para | 1.1 | 1.1 | 1.1 |
| Lumimnace_Para | 1.3 | 1.1 | 1.1 |

The parameter selection unit 150 changes the parameter table according to external luminance sensed by the luminance sensor 140 additionally included therein. In other words, when the overall luminance level of the input image must be increased due to high external luminance, power consumption significantly increases. Hence, the power consumption can be greatly reduced by setting the parameters to high values. However, it is understood that the luminance sensor 140 need not be used in all aspects of the invention.

Figure 10:
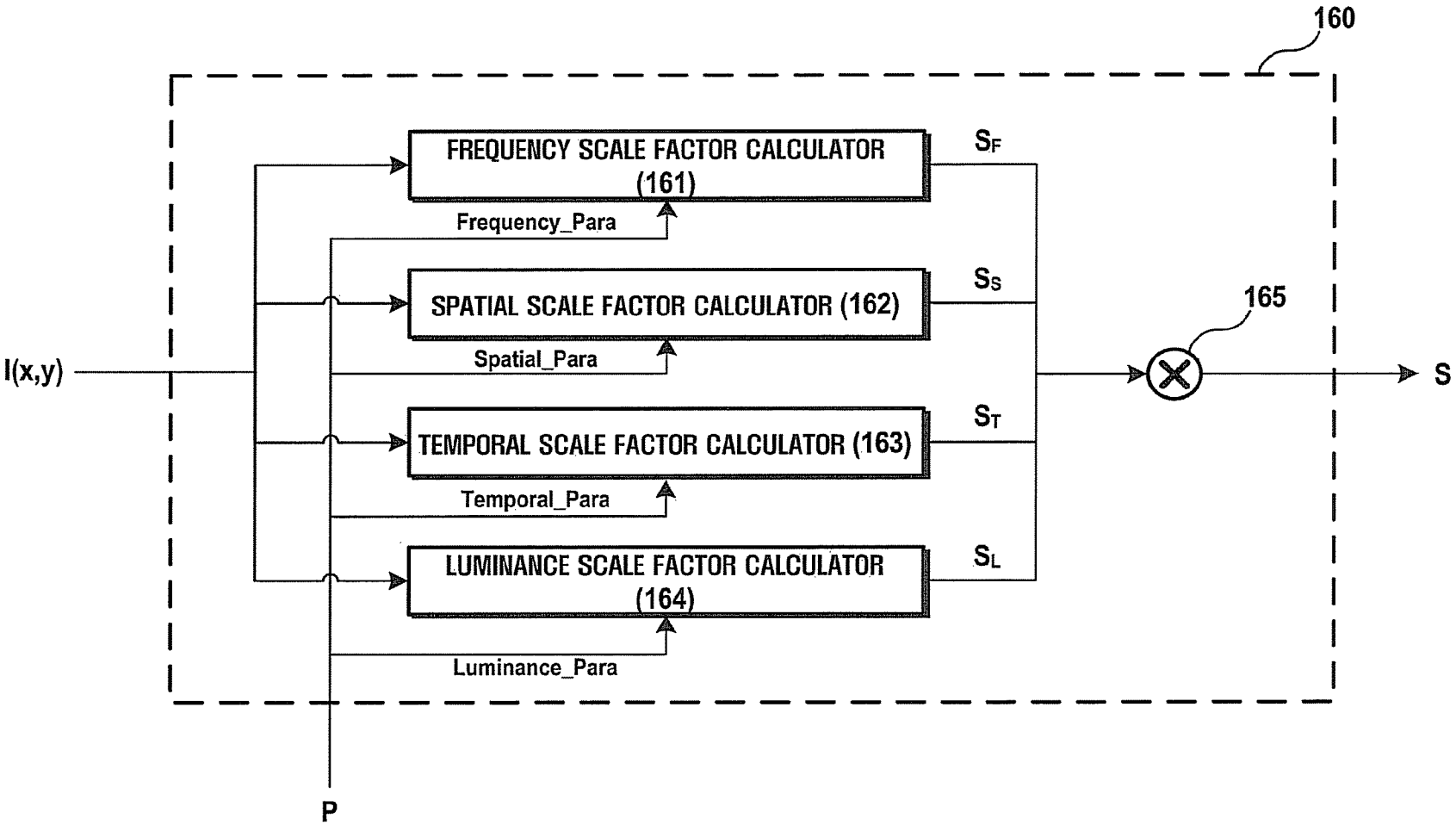
FIG. 10 is a detailed block diagram of a scale factor setting unit included in the image processing apparatus of FIG. 7.

The scale factor setting unit 160 sets a scale factor S to adjust the luminance component $I_{(x, y)}$ of the input image using the parameter P. The set scale factor S is provided to the first multiplier 170. A detailed configuration of an example of the scale factor setting unit 160 is illustrated in FIG. 10. As shown in FIG. 10, the scale factor setting unit 160 includes one of a frequency scale factor calculator 161, a spatial scale factor calculator 162, a temporal scale factor calculator 163, and a luminance scale factor calculator 164 and may further include a second multiplier 165. Any combination of the calculators 161 through 164 can be used in parallel with each other or may be used independently of each other to reduce power consumption.

The frequency scale factor calculator 161 calculates a frequency scale factor $S_F$ for the luminance component $I_{(x, y)}$ of the input image based on the frequency parameter Frequency_Para. To this end, the frequency scale factor calculator 161 extracts a high-frequency component from the input image. To extract the high-frequency component from the input image, a method of simply applying a high pass filter (HPF) to the input image may be considered. However, according to an embodiment of the invention, an image, which is obtained after a low pass filter (LPF) is applied to the input image, is subtracted from the input image to allow for a more precise extraction.

The size $H_{(x, y)}$ of the extracted high-frequency component may be defined by Equation (1). In Equation (1), $I_{(x, y)}$ indicates a luminance component of an input image, and $LPF_{(x, y)}$ indicates a component obtained after the LPF is applied to the luminance component.

$$H_{(x,y)}=|I_{(x,y)}-LPF_{(x,y)}| \quad (1).$$

If the calculated size of the high-frequency component is rearranged into an exponential function in consideration of gamma characteristics (gamma curve), the frequency scale factor $S_F$ may be defined by Equation (2).

$$S_F = 1 - \frac{[H_{(x,y)}]^{Frequency_Para}}{H_{(x,y)}} = 1 - [H_{(x,y)}]^{Frequency_Para-1}. \quad (2)$$

Referring to Equation (2), as the size $H_{(x, y)}$ of the high-frequency component increases, the size of the frequency scale factor $S_F$ is reduced. In other words, the luminance component of an output image is scaled to become smaller when the luminance component $I_{(x, y)}$ of the input image is a high-frequency component in comparison to when the luminance component $I_{(x, y)}$ of the input image is a low-frequency component. Such scaling takes advantage of the fact that the human visual system is less sensitive to high-frequency components as described above with references to FIGS. 4A through 4C.

$H_{(x, y)}$ is not a normalized value. Therefore, while not required in all aspects, $H_{(x, y)}$ may be normalized to a value between 0 and 1 before being substituted for Equation (2). For example, $H_{(x, y)}$ may be normalized by dividing $H_{(x, y)}$ by a maximum value that can be represented by $H_{(x, y)}$.

Figure 11A:
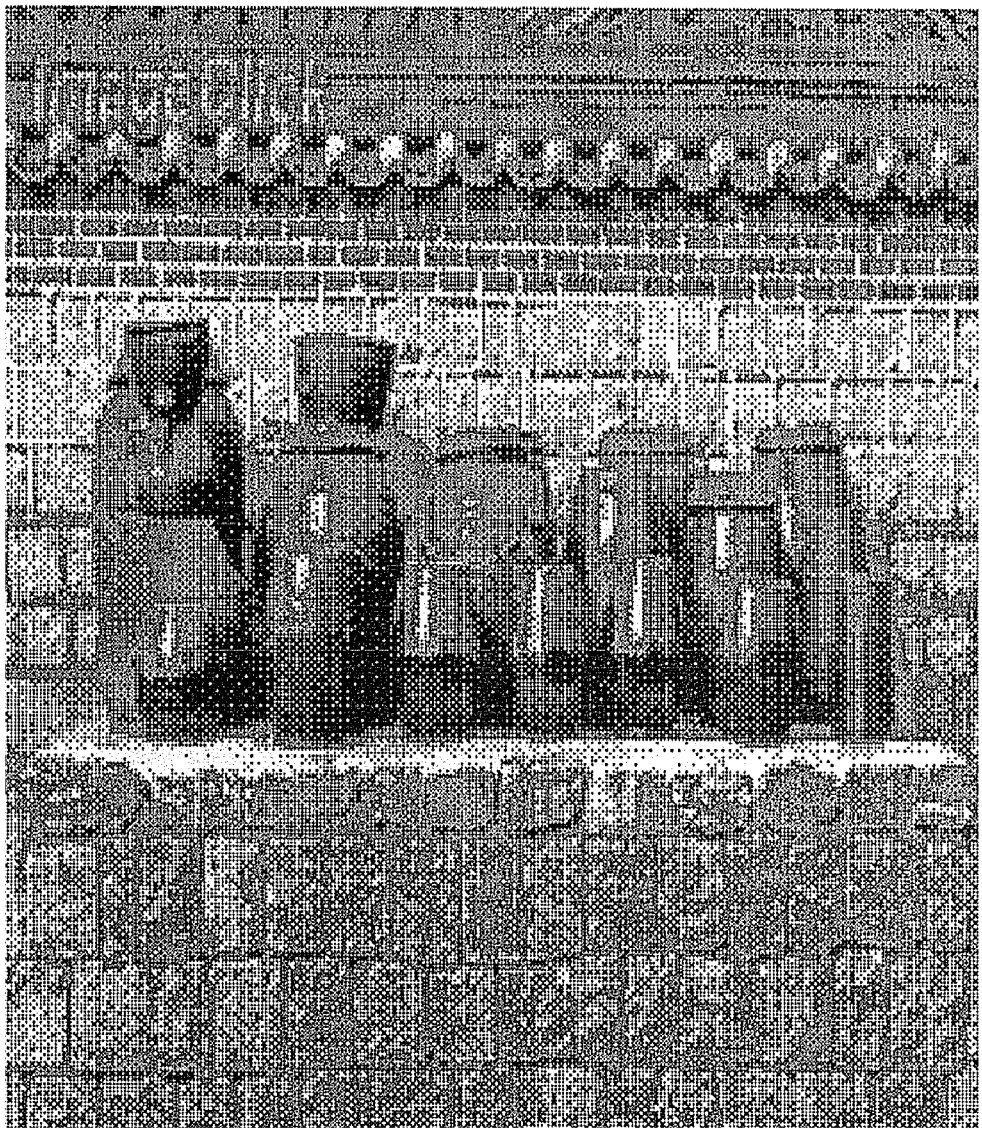
FIG. 11A illustrates an example of an input image.
Figure 11B:
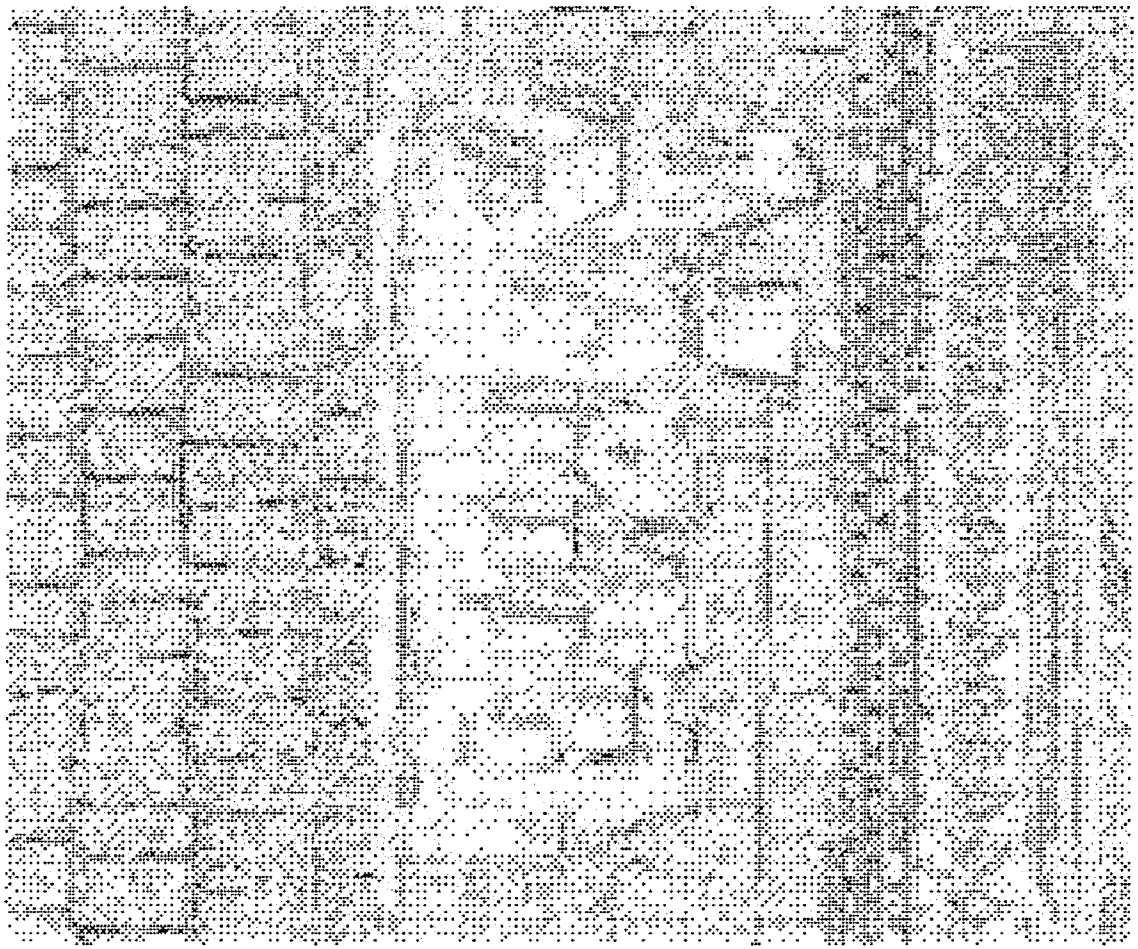
FIG. 11B illustrates the size of a high-frequency component of the input image of FIG. 11A.

The size of a high-frequency component of an input image illustrated in FIG. 11A is illustrated in FIG. 11B. Referring to FIG. 11B, the darker the input image, the greater the size of the high-frequency component. Dark portions in FIG. 11B are mostly composed of pixels having large luminance gradients, such as outlines of an object, compared with those in FIG. 11A.

Figure 12:
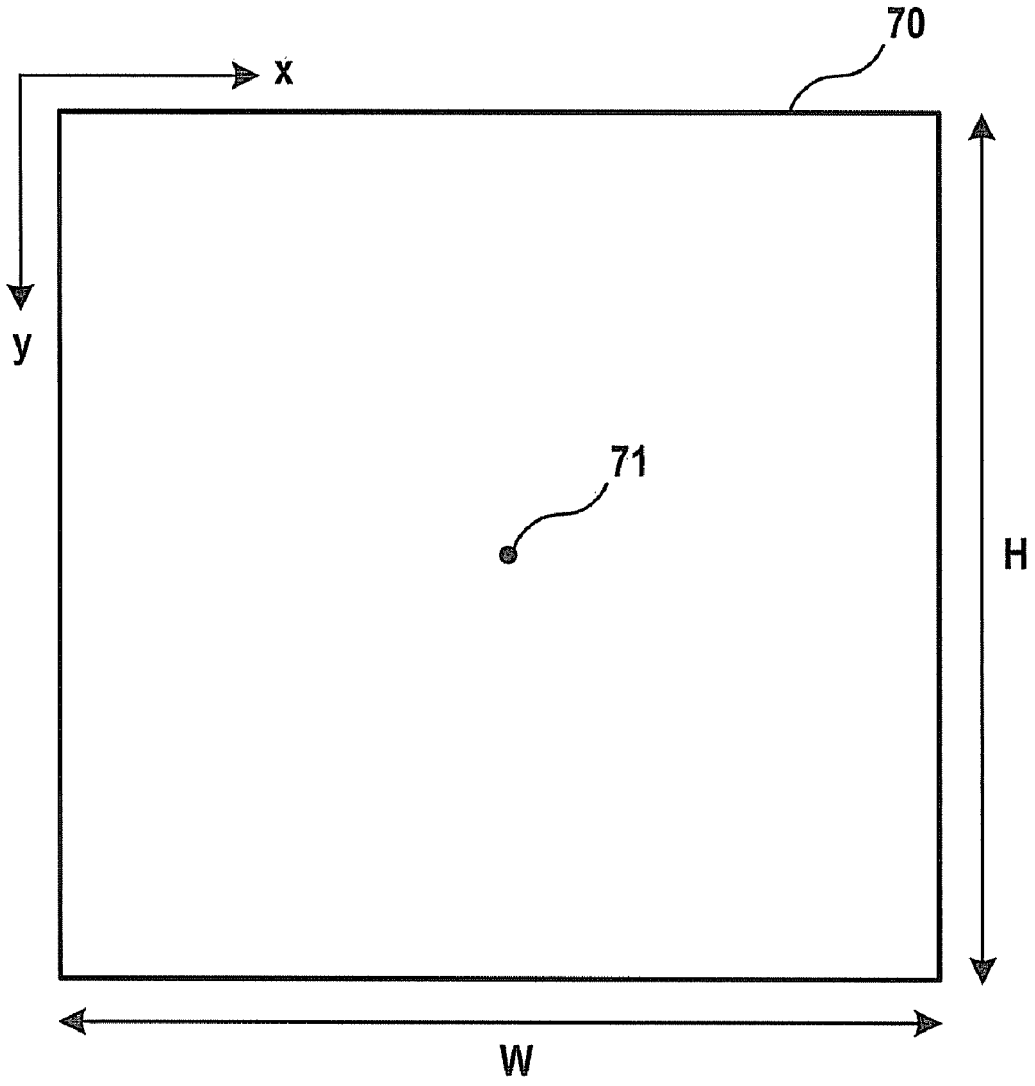
FIG. 12 is a diagram illustrating coordinate axes and a central position of an input image.

The spatial scale factor calculator 162 calculates a spatial scale factor $S_S$ for the luminance component $I_{(x, y)}$ of the input image based on the spatial parameter Spatial_Para. Such a calculation is made in consideration of the fact that the human psychological visual system is more sensitive to the center area of an image and less sensitive to outer areas of the image as described above with reference to FIG. 5. As shown in FIG. 12, a top left corner of an image 70 is a starting point of pixel coordinates of the image 70. When it is assumed that such characteristics have a Gaussian distribution and the Gaussian distribution is symmetric about a center 71 of the image 70, the starting point at the top left corner of the image 70 must be shifted to the center 71. Therefore, the spatial scale factor $S_S$ may be defined by Equation (3). In Equation (3), x and y respectively indicate an x-coordinate value and a y-coordinate value of a pixel, a starting point of which is a top left corner of an image, and W and H respectively indicate a horizontal size and a vertical size of the image. Ultimately, $$\left(x-\frac{1}{2}W\right)^2+\left(y-\frac{1}{2}H\right)^2$$

indicates the distance between a current pixel and the center 71 of the image 70, and the distance is normalized by dividing the distance $$\left(x-\frac{1}{2}W\right)^2+\left(y-\frac{1}{2}H\right)^2 \text{ by } W\times H.$$

$$S_S = 1 - \left[\text{Spatial_Para}\cdot\frac{\left(x-\frac{1}{2}W\right)^2+\left(y-\frac{1}{2}H\right)^2}{W\cdot H}\right]. \quad (3)$$

It can be understood from Equation (3) that the farther from the center of an image, the smaller the size of the spatial scale factor $S_S$. In other words, the luminance components of pixels located in outer areas of an image are scaled to become smaller than those of pixels located in the center area of the image.

Figure 13A:
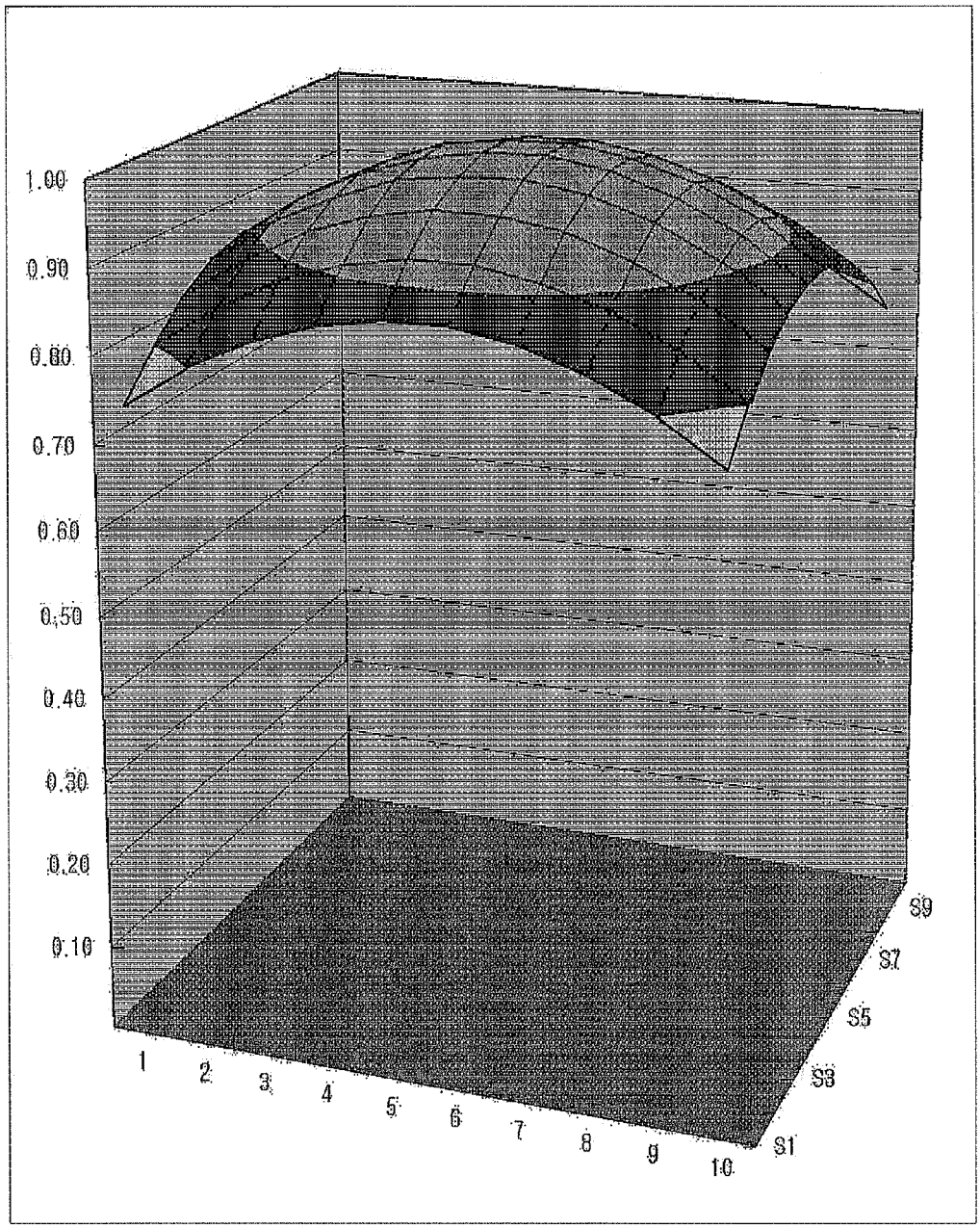
FIG. 13A illustrates the distribution of a spatial scale factor when a spatial parameter is 0.5.
Figure 13B:
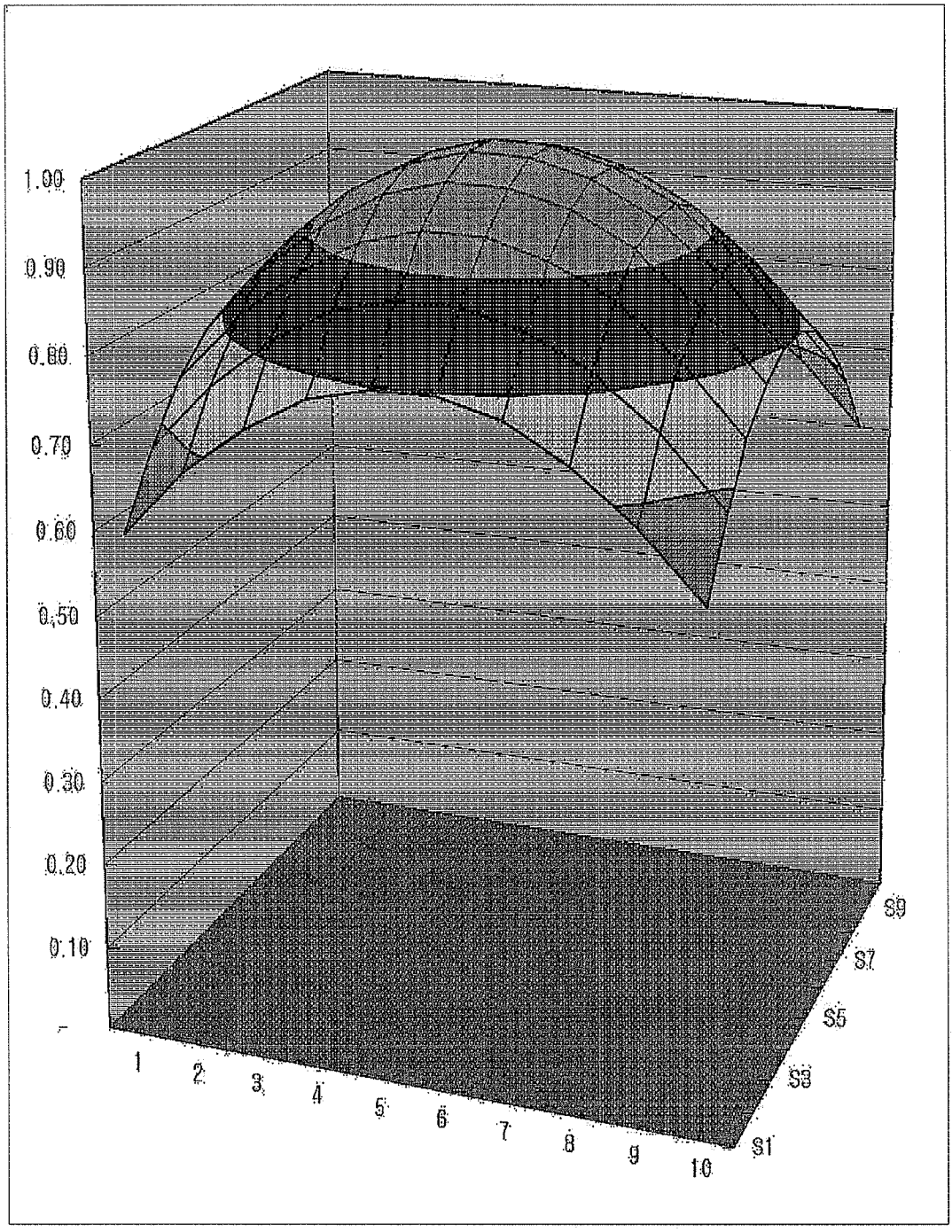
FIG. 13B illustrates the distribution of the spatial scale factor when the spatial parameter is 0.8.

The spatial parameter Spatial_Para determines the scaling intensity of the outer areas with respect to that of the center area of the image. The greater the value of the spatial parameter Spatial_Para, the greater the reduction in power consumption. FIG. 13A illustrates the distribution of the spatial scale factor $S_S$ when the spatial parameter Spatial_Para is 0.5, and FIG. 13B illustrates the distribution of the spatial scale factor $S_S$ when the spatial parameter Spatial_Para is 0.8. It can be understood from the comparison of FIGS. 13A and 13B that the spatial scaling effect becomes greater as the value of the spatial parameter Spatial_Para increases.

The temporal scale factor calculator 163 calculates a temporal scale factor $S_T$ for the luminance component $I_{(x, y)}$ of the input image based on the temporal parameter Temporal_Para. Such a calculation is made in consideration of the fact that perceiving changes in pixels having large temporal gradients in a moving image is difficult for the human visual system, as described above with reference to FIG. 6.

To calculate the temporal scale factor $S_T$, the temporal scale factor calculator 163 must calculate the temporal gradient of the luminance component $I_{(x, y)}$ of the input image. The temporal scale factor calculator 163 may calculate the difference in luminance between corresponding pixels. However, according to an embodiment of the invention, pixels may be considered around a corresponding pixel.

According to an embodiment of the present invention, as an example of the temporal gradient, a frame-to-frame change in the sum of luminance of pixels in a block of a predetermined size having a current pixel at a center thereof (that is, the current pixel is located at the center of the block) is calculated. The size of the block may be 5×5 pixels.

The temporal gradient $D_{(x, y)}$ of the luminance of the current pixel may be defined by, for example, Equation (4) or (5), where $I_j^n$ indicates the luminance of 25 pixels included in the 5×5 block.

$$D_{(x,y)} = \left| \sum_i^{5\times5} I_i^{n-1} - \sum_i^{5\times5} I_i^n \right|. \tag{4}$$

$$D_{(x,y)} = \left| \frac{\sum_i^{5\times5} I_i^{n-1}}{\sum_i^{5\times5} I_i^n} - 1 \right|. \tag{5}$$

In Equation (4), since $D_{(x, y)}$ is a value that has not been normalized, $D_{(x, y)}$ must be normalized to a value between 0 and 1. $D_{(x, y)}$ in Equation (5) is a normalized value. In theory, the value of $D_{(x, y)}$ in Equation (5) may be equal to or greater than zero. However, in reality, if the value of $D_{(x, y)}$ is greater than 1, the difference in luminance between corresponding pixels is very large. Therefore, the value of $D_{(x, y)}$ may be regarded as 1. In other words, all values of $D_{(x, y)}$ exist between 0 and 1.

If gamma characteristics are considered as in Equation (2), the temporal scale factor $S_T$ may be rearranged into an exponential function. Therefore, the temporal scale factor $S_T$ may be defined by Equation (6).

$$S_F = 1 - \frac{[D_{(x,y)}]^{Temporal_Para}}{D_{(x,y)}} = 1 - [D_{(x,y)}]^{Temporal_Para-1}. \tag{6}$$

Referring to Equation (6), as the temporal gradient of luminance increases, the size of the temporal scale factor $S_T$ is reduced. In other words, the luminance component of the output image is scaled to become smaller when the temporal gradient of the luminance component $I_{(x, y)}$ of the input image is large as compared to when the temporal gradient of the luminance component $I_{(x, y)}$ of the input image is small.

The luminance scale factor calculator 164 calculates a luminance scale factor $S_L$ for the luminance component of the input image based on the luminance parameter Luminance_Para. The human visual system is relatively less sensitive to dark pixels than to bright pixels. In other words, the human visual system can easily distinguish the difference in luminance between pixels on a bright screen. However, it is relatively difficult for the human visual system to distinguish the difference between pixels on a dark screen. Therefore, the luminance scale factor calculator 164 sets a larger luminance scale factor on a dark screen. When gamma characteristics are considered as in Equations (2) and (4), the luminance scale factor $S_L$ may be defined by Equation (7).

$$S_L = \frac{[I_{(x,y)}]^{Luminance_Para}}{I_{(x,y)}} = [I_{(x,y)}]^{Luminance_Para-1}. \tag{7}$$

Referring to FIG. 7, the lower the luminance of the current pixel of the input image, the size of the luminance scale factor $S_L$ is reduced.

The calculators 161 through 164 calculate the scale factors $S_F$, $S_S$, $S_T$ and $S_L$, respectively, in units of pixels of the input image. The second multiplier 165 multiplies the scale factors $S_F$, $S_S$, $S_T$ and $S_L$ calculated by the calculators 161 through 164, respectively, and produces a final scale factor S. If the input image is a still image, the temporal scale factor $S_T$ may be excluded. If only some of the calculators 161 through 164 are used to save power, only the scale factors calculated by the used calculators are multiplied by one another.

Referring back to FIG. 7, the first multiplier 170 multiplies the final scale factor S calculated by the scale factor setting unit 160 by the luminance component $I_{(x, y)}$ of the input image and outputs an output luminance component $I'_{(x, y)}$.

According to experimental results, the image processing apparatus 100, according to aspects of the present embodiment of the present invention, achieves an approximately 20% reduction in power consumption in the case of still images and an approximately 30% reduction in power consumption in the case of moving images.

The components described above with references to FIGS. 7 and 10 may be implemented as software components such as tasks, classes, subroutines, processes, objects, executable threads or programs performed in a predetermined region of a memory or implemented as hardware components such as a Field Programmable Gate Array (FPGA) or Application Specific Integrated Circuit (ASIC). Alternatively, the components may be composed of a combination of the software and hardware components. These components may be stored in a computer-readable storage medium, and some of the components may be distributed in a plurality of computers.

Figure 14:
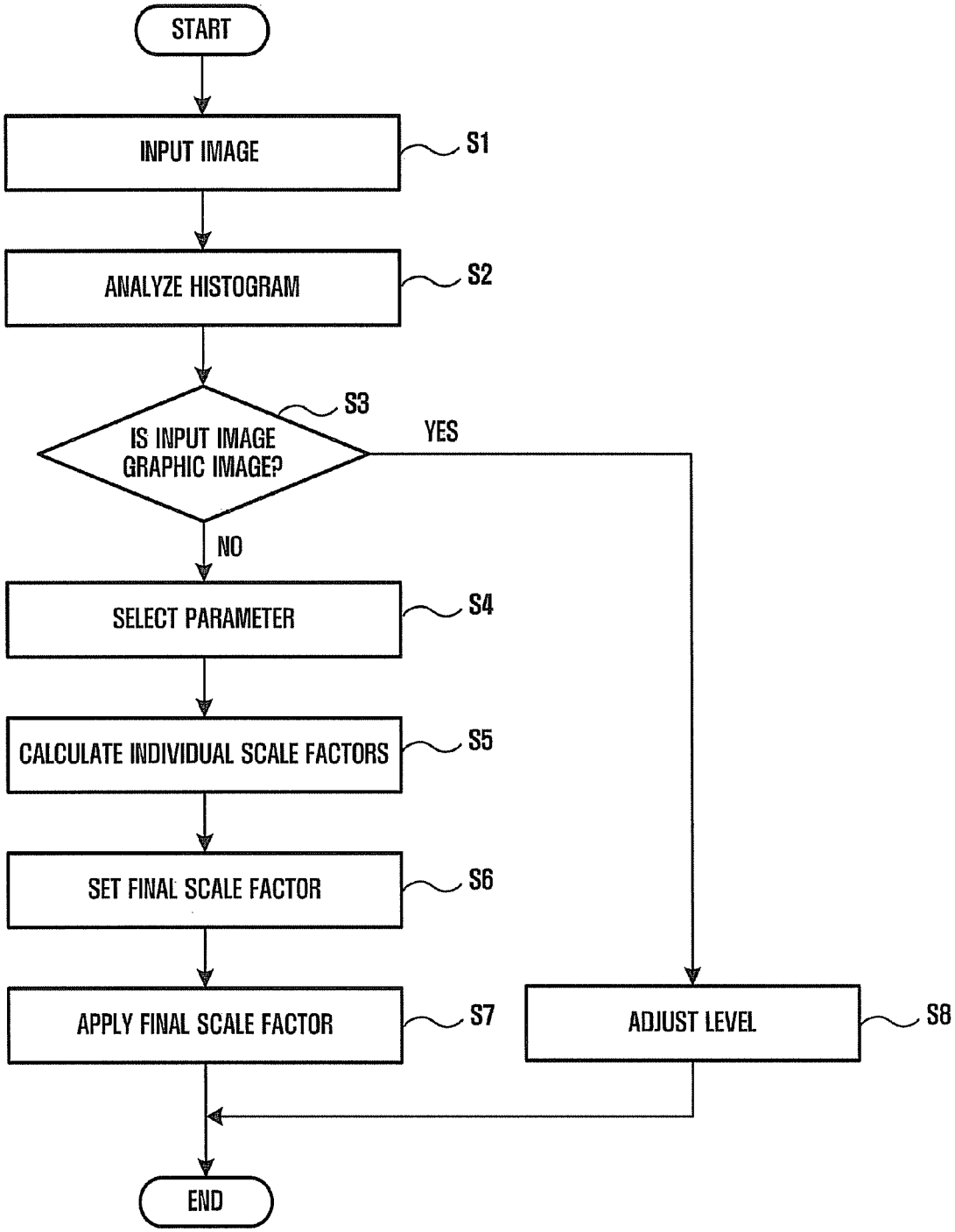
FIG. 14 is a flowchart illustrating an image adjustment method according to an embodiment of the present invention.

FIG. 14 is a flowchart illustrating an image adjustment method according to an embodiment of the present invention. As shown in FIG. 14, once an image is input (operation S1), the image analysis unit 110 extracts a luminance component $I_{(x, y)}$ of the input image, generates a histogram, analyzes the distribution of the generated histogram, and classifies the input image based on the analysis (operation S2). As a result of the classification, if the input image is a graphic image (yes to the question raised in operation S3), the level adjustment unit 130 uniformly scales down the level of the input image or the luminance component $I_{(x, y)}$ of the input image (operation S8). If the input image is not a graphic image (no to the question raised in operation S3), the parameter selection unit 150 selects an appropriate parameter according to whether the input image is a dark image, a bright image, or a general image (operation S4). The parameter may include all or part of the frequency parameter Frequency_Para, the spatial parameter Spatial_Para, the temporal parameter Temporal_Para, and the luminance parameter Luminance_Para. The parameter selection unit 150 may change the selected parameter according to external luminance.

Next, the scale factor setting unit 160 calculates individual scale factors to adjust the luminance component $I_{(x, y)}$ of the input image using the parameter (operation S5) and sets a final scale factor by multiplying the calculated individual scale factors by one another (operation S6). A detailed process of calculating the individual scale factors has been described above with reference to FIG. 10 and thus will not be described here. Finally, the first multiplier 170 multiplies the set final scale factor by the luminance component $I_{(x, y)}$ of the input image and output a changed luminance component (operation S7).

As is described above, an image processing apparatus and method according to aspects of the present invention dynamically reduce the power consumption of a self-luminous display apparatus according to characteristics of an input image.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image processing apparatus to reduce power consumption of a self-luminous display, the apparatus comprising:

a parameter selection unit to select a parameter to adjust a degree to which power consumption is reduced;

a scale factor setting unit to extract a high-frequency component of a current pixel in an input image and to set a scale factor according to the selected parameter and a size of the extracted high-frequency component based on a human visual system; and a multiplier to multiply the current pixel by the set scale factor and to output a result of the multiplication, wherein the parameter is one of a frequency parameter, a spatial parameter, a temporal parameter and a luminance parameter, wherein the scale factor decreases as the size of the high-frequency component and the parameter increase.

2. The apparatus according to claim 1, further comprising an image analysis unit to generate a histogram of luminance components of the input image, to analyze the distribution of the generated histogram, and to classify the input image based on a result of the analysis.

3. The apparatus according to claim 2, wherein the parameter selection unit selects the parameter according to a result of the classification of the input image.

4. The apparatus according to claim 3, further comprising a luminance sensor to sense an external luminance, wherein the parameter selection unit selects the parameter according to the sensed external luminance.

5. The apparatus according to claim 3, further comprising a level adjustment unit to uniformly scale down a level of the input image when the image analysis unit classifies the input image as a graphic image having images of a single color.

6. The apparatus according to claim 4, wherein the parameter is selected according to whether the input image is a light image a dark image, and a normal image.

7. The apparatus according to claim 1, wherein a size of the high-frequency component is a size of a component obtained after a high pass filter (HPF) is applied to the luminance component of the current pixel.

8. A display panel comprising the image processing apparatus of claim 1 and further comprising:

a display on which the image adjusted by the image processing apparatus is displayed; and a controller controlling the image processing apparatus and the display to display the input image as the adjusted image on the display.

9. An image processing apparatus to reduce power consumption of a self-luminous display, the apparatus comprising:

a parameter selection unit to select a parameter to adjust a degree to which power consumption is reduced;

a scale factor setting unit to extract a high-frequency component of a current pixel in an input image and to set a scale factor according to the selected parameter and a size of the extracted high-frequency component; and a multiplier to multiply the current pixel by the set scale factor and to output a result of the multiplication, wherein a size of the high-frequency component is a difference between a luminance component of the current pixel and a luminance component obtained after a low pass filter (LPF) is applied to the luminance component of the current pixel.

10. The apparatus according to claim 9, wherein the scale factor decreases as the size of the high-frequency component and the parameter increase.

11. The apparatus according to claim 10, wherein the scale factor is calculated by subtracting a result of exponentiating a size of the high-frequency component and the parameter from a predetermined constant.

12. An image processing apparatus to reduce power consumption of a self-luminous display, the apparatus comprising:

a parameter selection unit to select a parameter to adjust a degree to which power consumption is reduced;

a scale factor setting unit to calculate a distance between a current pixel in an input image and a center of the input image and to set a scale factor according to the selected parameter and the calculated distance based on a human visual system; and a multiplier to multiply the current pixel by the set scale factor and to output a result of the multiplication, wherein the parameter comprises one of a frequency parameter that determines a level of a high-frequency component to be extracted from the input image, a spatial parameter that determines the adjustment to the luminance component of the input image by calculating positions of respective pixels with respect to a distance between the respective pixels and a predetermined point in the input image, a temporal parameter that determines the adjustment to the luminance component of the input image by calculating a luminance gradient of respective pixels, and a luminance parameter that increases and decreases the scale factors based on the relative darkness of the input image.

13. The apparatus according to claim 12, further comprising an image analysis unit to generate a histogram of luminance components of the input image, to analyze the distribution of the generated histogram, and to classify the input image based on a result of the analysis.

14. The apparatus according to claim 13, wherein the parameter selection unit selects the parameter according to a result of the classification of the input image.

15. The apparatus according to claim 14, further comprising a luminance sensor to sense an external luminance, wherein the parameter selection unit selects the parameter according to the sensed external luminance.

16. The apparatus according to claim 15, wherein the parameter is selected according to whether the input image is a light image a dark image, and a normal image.

17. An image processing apparatus to reduce power consumption of a self-luminous display, the apparatus comprising:

a parameter selection unit to select a parameter to adjust a degree to which power consumption is reduced;

a scale factor setting unit to calculate a distance between a current pixel in an input image and a center of the input image and to set a scale factor according to the selected parameter and the calculated distance; and a multiplier to multiply the current pixel by the set scale factor and to output a result of the multiplication, wherein the scale factor decreases as the distance and the parameter increase and the scale factor is calculated by subtracting the result of multiplying the distance by the parameter from a predetermined constant.

18. An image processing apparatus to reduce power consumption of a self-luminous display, the apparatus comprising:

a parameter selection unit to select a parameter to adjust a degree to which power consumption is reduced for a display of an input image;

a scale factor setting unit to calculate a temporal gradient of a luminance of a current pixel in the input image and to set a scale factor according to the selected parameter and the calculated temporal gradient based on a human visual system; and a multiplier to multiply the current pixel by the set scale factor and to output a result of the multiplication, wherein the parameter is one of a frequency parameter, a spatial parameter, a temporal parameter and a luminance parameter, wherein the scale factor decreases as the temporal gradient and the parameter increase.

19. The apparatus according to claim 18, further comprising an image analysis unit to generate a histogram of luminance components of the input image, to analyze the distribution of the generated histogram, and to classify the input image based on a result of the analysis.

20. The apparatus according to claim 19, wherein the parameter selection unit selects the parameter according to a result of the classification of the input image.

21. The apparatus according to claim 19, further comprising a luminance sensor to sense an external luminance, wherein the parameter selection unit selects the parameter according to the sensed external luminance.

22. The apparatus according to claim 21, wherein the temporal gradient is a frame-to-frame change in a sum of luminance of a predetermined sized block and having the current pixel at a center thereof.

23. The apparatus according to claim 22, wherein the size of the block is 5×5 pixels.

24. An image processing apparatus to reduce power consumption of a self-luminous display, the apparatus comprising:

a parameter selection unit to select a parameter to adjust a degree to which power consumption is reduced for a display of an input image;

a scale factor setting unit to calculate a temporal gradient of a luminance of a current pixel in the input image and to set a scale factor according to the selected parameter and the calculated temporal gradient; and a multiplier to multiply the current pixel by the set scale factor and to output a result of the multiplication, wherein the scale factor decreases as the temporal gradient and the parameter increase and the scale factor is calculated by subtracting a result of exponentiating the temporal gradient and the parameter from a predetermined constant.

25. An image processing apparatus to reduce power consumption of a self-luminous display, the apparatus comprising:

a parameter selection unit to select a parameter to adjust a degree to which power consumption is reduced for a display of an input image;

a scale factor setting unit to extract a luminance component of a current pixel in the input image and to set a scale factor according to the selected parameter and a size of the extracted luminance component based on a human visual system; and a multiplier to multiply the current pixel by the set scale factor and to output a result of the multiplication, wherein the parameter is one of a frequency parameter, a spatial parameter, a temporal parameter and a luminance parameter, wherein the scale factor increases as the size of the luminance component and the parameter increase.

26. The apparatus according to claim 25, wherein the scale factor increases as the size of the luminance component and the parameter increase.

27. The apparatus according to claim 26, wherein the scale factor is calculated by subtracting a result of exponentiating a size of the luminance component and the parameter from a predetermined constant.

28. An image processing method to reduce power consumption of a self-luminous display, the method comprising:

selecting a parameter to allow for an adjustment of a degree to which power consumption is reduced for a display of an input image;

extracting a high-frequency component of a current pixel in the input image;

setting a scale factor according to the selected parameter and a size of the extracted high-frequency component based on a human visual system;

multiplying the current pixel by the set scale factor; and outputting a result of the multiplication, wherein the parameter is one of a frequency parameter, a spatial parameter, a temporal parameter and a luminance parameter, wherein the scale factor decreases as the size of the high-frequency component and the parameter increase.

29. A non-transitory computer readable medium encoded with processing instructions for implementing the method of claim 28 using a computer.

30. An image processing method to reduce power consumption of a self-luminous display, the method comprising:

selecting a parameter to allow for an adjustment of a degree to which power consumption is reduced for a display of an input image;

calculating a distance between a current pixel in the input image and a center of the input image;

setting a scale factor according to the selected parameter and the calculated distance based on a human visual system;

multiplying the current pixel by the set scale factor; and outputting a result of the multiplication, wherein the parameter comprises one of a frequency parameter that determines a level of a hiqh-frequency component to be extracted from the input image, a spatial parameter that determines the adjustment to the luminance component of the input image by calculating positions of respective pixels with respect to a distance between the respective pixels and a predetermined point in the input image, a temporal parameter that determines the adjustment to the luminance component of the input image by calculating a luminance gradient of respective pixels, and a luminance parameter that increases and decreases the scale factors based on the relative darkness of the input image.

31. A non-transitory computer readable medium encoded with processing instructions for implementing the method of claim 30 using a computer.

32. An image processing method to reduce power consumption of a self-luminous display, the method comprising:

selecting a parameter to allow for an adjustment of a degree to which power consumption is reduced for a display of an input image;

calculating a temporal gradient of luminance of a current pixel in the input image;

setting a scale factor according to the selected parameter and the calculated temporal gradient based on a human visual system;

multiplying the current pixel by the set scale factor; and outputting a result of the multiplication, wherein the parameter is one of a frequency parameter, a spatial parameter, a temporal parameter and a luminance parameter, wherein the scale factor decreases as the temporal gradient and the parameter increase.

33. A non-transitory computer readable medium encoded with processing instructions for implementing the method of claim 32 using a computer.

34. An image processing method to reduce power consumption of a self-luminous display, the method comprising:

selecting a parameter to allow for an adjustment of a degree to which power consumption is reduced;

extracting a luminance component of a current pixel in an input image and setting a scale factor according to the selected parameter and a size of the extracted luminance component based on a human visual system;

multiplying the current pixel by the set scale factor; and outputting a result of the multiplication, wherein the parameter is one of a frequency parameter, a spatial parameter, a temporal parameter and a luminance parameter, wherein the scale factor increases as the size of the luminance component and the parameter increase.

35. A non-transitory computer readable medium encoded with processing instructions for implementing the method of claim 34 using a computer.

36. An image adjustment method, comprising:

extracting a luminance component of an input image;

following a classification of the input image, uniformly scaling down a level or the luminance component of the input image if the input image is a graphic image having only a single color and, if the input image is not the graphic image, selecting an appropriate parameter according to whether the input image is a dark image, a bright image, or a general image;

calculating individual scale factors to adjust the luminance component of the input image using the selected parameter;

setting a final scale factor by multiplying the calculated individual scale factors by one another;

multiplying the set final scale factor by the luminance component of the input image; and outputting a changed luminance component to reduce a power consumption to display the image.

37. The method according to claim 36, wherein the classification of the input image comprises:

generating a histogram of the luminance component; and analyzing a distribution of the generated histogram.

38. The method according to claim 36, wherein the parameter comprises a frequency parameter that determines a level of a high-frequency component to be extracted from the input image, a spatial parameter that determines the adjustment to the luminance component of the input image by calculating positions of respective pixels with respect to a distance between the respective pixels and a predetermined point in the input image, a temporal parameter that determines the adjustment to the luminance component of the input image by calculating a luminance gradient of respective pixels, and a luminance parameter that increases and decreases the scale factors based on the relative darkness of the input image.

39. A non-transitory computer readable medium encoded with processing instructions for implementing the method of claim 36 using a computer.

* * * * *

UNITED STATES PATENT AND TRADEMARK OFFICE

CERTIFICATE OF CORRECTION

PATENT NO. : 8,134,549 B2
APPLICATION NO. : 11/761875
DATED : March 13, 2012
INVENTOR(S) : Young-ran Han et al.

It is certified that error appears in the above-identified patent and that said Letters Patent is hereby corrected as shown below:

Column 11, Line 56, In Claim 6, delete “image a” and insert -- image, a --, therefor.

Column 12, Line 64, In Claim 16, delete “image a” and insert -- image, a --, therefor.

Column 14, Line 59, In Claim 30, delete “hiqh” and insert -- high --, therefor.

Signed and Sealed this
Twenty-second Day of May, 2012

David J. Kappos

David J. Kappos
*Director of the United States Patent and Trademark Office*